US012796775B2

(12) United States Patent
Goetgeluk et al.

(10) Patent No.: US 12,796,775 B2
(45) Date of Patent: Nov. 17, 2026

(54) ANTI-SLIP FOOTWEAR WITH ROTATABLE TRACTION ELEMENT

(71) Applicant: Virtuix Holdings Inc., Austin, TX (US)

(72) Inventors: Jan Goetgeluk, Austin, TX (US); Ronald Kurt Bender, Dripping Springs, TX (US); James Douglas Shuffield, Cedar Park, TX (US)

(73) Assignee: Virtuix Holdings Inc., Austin, TX (US)

( * ) Notice: Subject to any disclaimer, the term of this patent is extended or adjusted under 35 U.S.C. 154(b) by 708 days.

(21) Appl. No.: 17/944,055

(22) Filed: Sep. 13, 2022

(65) Prior Publication Data

US 2024/0081479 A1 Mar. 14, 2024

(51) Int. Cl.
*A43B 13/22* (2006.01)
*A43C 15/00* (2006.01)
(Continued)

(52) U.S. Cl.
CPC ..... *A43B 13/223* (2013.01); *A43C 15/00* (2013.01); *A43C 15/06* (2013.01); *A63B 22/02* (2013.01);
(Continued)

(58) Field of Classification Search
None
See application file for complete search history.

(56) References Cited

U.S. PATENT DOCUMENTS 6,360,455 B1 * 3/2002 Seo ..... A43C 15/14 36/134
6,385,865 B1 * 5/2002 Jang ..... A43C 15/066 36/62
(Continued)

FOREIGN PATENT DOCUMENTS

FR 300875 A1 7/2014

OTHER PUBLICATIONS

International Search Report and Written Opinion for PCT Application No. PCT/US2023/073943, dated Jan. 12, 2024, 11 pages.

*Primary Examiner* — Alissa L Hoey
*Assistant Examiner* — Akwokwo Olabisi Redhead
(74) *Attorney, Agent, or Firm* — Polsinelli PC

(57) ABSTRACT

An anti-slip footwear that can be used with an omnidirectional locomotion system or other virtual reality (VR) environment technology includes at least a sole layer and a rotatable traction portion. The sole layer includes an upper surface and a lower surface, wherein the lower surface includes one or more friction reducing elements having a first coefficient of friction with a platform of an omnidirectional treadmill. The rotatable traction portion is rotatably coupled to the lower surface of the sole layer and has a first face and a second face opposite from the first face. The first face includes one or more friction pads each having a second coefficient of friction with the platform of the omnidirectional treadmill that is greater than the first coefficient of friction. The rotatable traction portion can be rotated to a first, low-friction position in which the second face makes contact with a ground surface. The rotatable traction portion can be rotated to a second, high-friction position in which the one or more friction pads make contact with the ground surface.

20 Claims, 5 Drawing Sheets

(51) Int. Cl.

| | |
|---|---|
| ***A43C 15/06*** | (2006.01) |
| ***A63B 22/02*** | (2006.01) |
| ***A63C 17/04*** | (2006.01) |
| ***A63C 17/16*** | (2006.01) |

(52) U.S. Cl.
CPC ..... *A63C 17/04* (2013.01); *A63C 17/16* (2013.01); *A63B 2022/0271* (2013.01)

(56) References Cited

U.S. PATENT DOCUMENTS

| | | | | |
|---|---|---|---|---|
| 6,675,504 | B1 * | 1/2004 | Biancucci | A43C 15/08 36/61 |
| 7,269,916 | B2 * | 9/2007 | Biancucci | A43B 3/246 36/61 |
| 7,836,610 | B2 * | 11/2010 | Laporte | A43C 15/08 36/62 |
| 8,250,779 | B2 * | 8/2012 | Bell | A43C 15/02 36/7.1 R |
| 8,256,144 | B2 * | 9/2012 | Comoli | A43B 1/0054 36/61 |
| 8,341,855 | B2 * | 1/2013 | Teteriatnikov | A43B 3/0042 36/8.3 |
| 11,191,318 | B2 * | 12/2021 | Biancucci | A43C 15/02 |
| 2004/0035024 | A1 * | 2/2004 | Kao | A43C 15/14 36/61 |
| 2012/0066938 | A1 | 3/2012 | French et al. | |
| 2015/0342305 | A1 | 12/2015 | Larson et al. | |

* cited by examiner

ANTI-SLIP FOOTWEAR WITH ROTATABLE TRACTION ELEMENT

TECHNICAL FIELD

The present disclosure pertains to an anti-slip footwear with a rotatable traction element and more particularly relates to an anti-slip footwear that can be used with an omnidirectional locomotion system and/or a walkable virtual reality (VR) system.

BRIEF DESCRIPTION OF THE DRAWINGS

In order to describe the manner in which the features of the disclosure can be obtained, a more particular description of the principles briefly described above will be rendered by reference to specific examples thereof which are illustrated in the appended drawings. Understanding that these drawings depict only example embodiments of the disclosure and are not therefore to be considered to be limiting of its scope, the principles herein are described and explained with additional specificity and detail through the use of the accompanying drawings in which.

DETAILED DESCRIPTION

Figure 1:
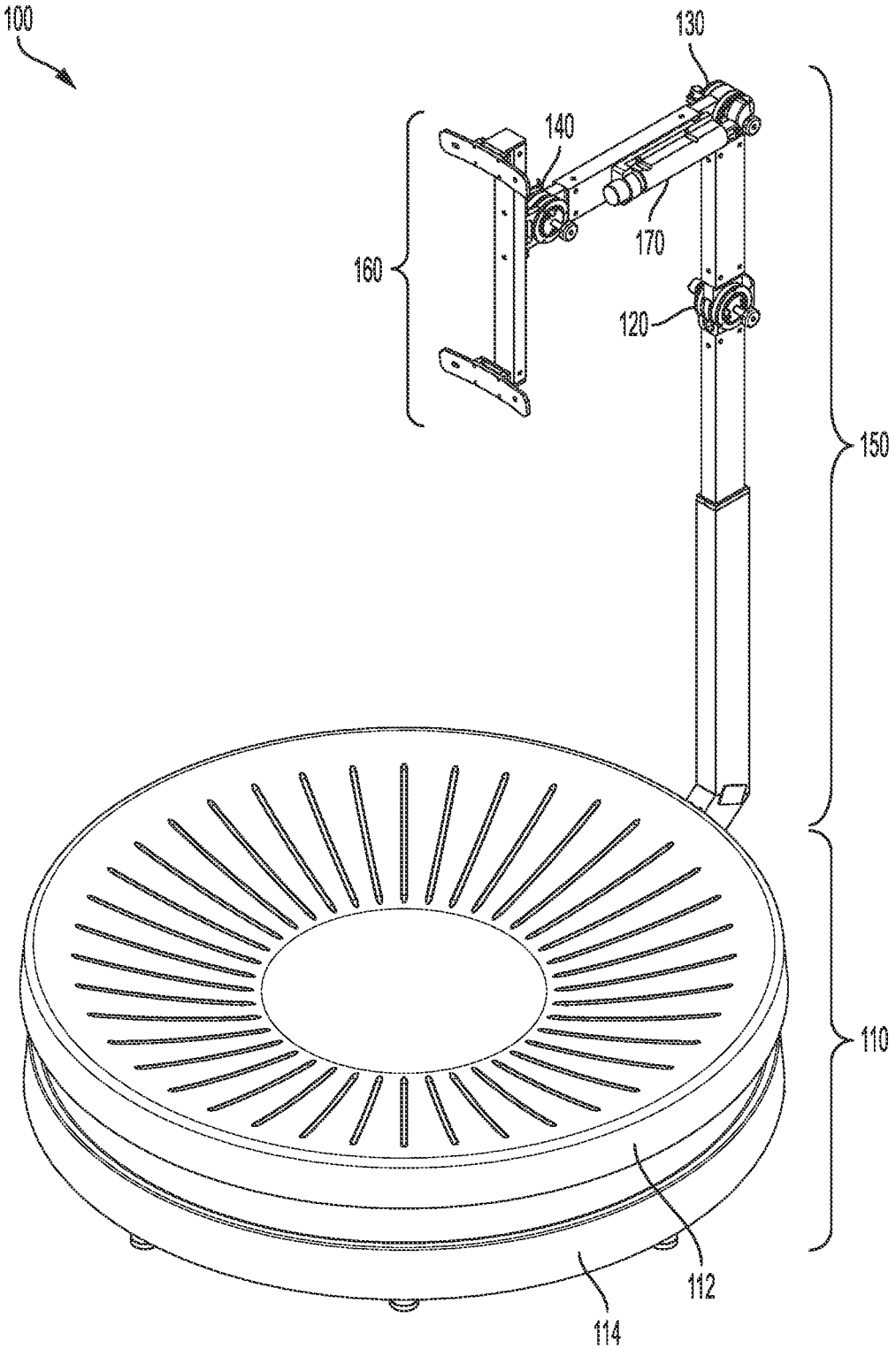
FIG. 1 is a perspective view of an example omnidirectional locomotion system according to one or more aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. It will be appreciated that for simplicity and clarity of illustration, where appropriate, reference numerals have been repeated among the different figures to indicate corresponding or analogous elements. The description is not to be considered as limiting the scope of the embodiments described herein.

Disclosed herein are systems and apparatus that can be used to provide adjustable traction to users of an omnidirectional locomotion system and/or a walkable virtual reality (VR) system. For example, an anti-slip footwear (e.g., an overshoe) can be provided that is configured to engage with, receive, or otherwise removably attach to an outer portion of a user's shoe, footwear, bare foot, etc. In some examples, the anti-slip footwear can be provided as a shoe, without departing from the scope of the present disclosure. In one illustrative example, the anti-slip footwear described herein can include at least one rotatable traction element (e.g., also referred to as a "rotatable traction portion" herein), wherein rotation of the rotatable traction element can increase and/or decrease the traction (e.g., friction force) between the user's feet and a surface upon which the user is standing, walking, running, etc. In some aspects, the rotatable traction element can be provided on a bottom or lower surface of a sole layer included in the anti-slip footwear. An upper surface of the sole layer included in the anti-slip footwear can be configured to make contact with or otherwise receive the user's foot, shoe, or other footwear. For example, when the anti-slip footwear is an anti-slip overshoe, the anti-slip overshoe can receive and attach to the user's foot, shoe, or other user footwear. In embodiments where the anti-slip footwear is a shoe, at least the rotatable traction element described herein can be integrally formed with the bottom surface of a shoe (e.g., integrally formed with a sole of the shoe). In some examples, the rotatable traction element and sole layer described herein can be integrally formed with the bottom surface of a shoe. In some embodiments, the rotatable traction element can include a first face and a second face each having a different material composition and/or each having a different coefficient of friction with a surface upon which a user wearing the anti-slip footwear stands, walks, runs, etc. For example, the rotatable traction element can include a first face and a second face each having a different coefficient of friction with a platform of an omnidirectional locomotion system. The rotatable traction element can be rotatable between at least a first position and a second position, wherein in the first position, a friction decreasing face of the rotatable traction element (e.g., a face having a lesser coefficient of friction with a platform of an omnidirectional locomotion system) is oriented in a downward direction and contacts the surface upon which the user is standing. In the second position, a friction increasing face (e.g., a traction face) of the rotatable traction element (e.g., a face having a greater coefficient of friction with the platform of the omnidirectional locomotion system) is oriented in the downward direction and contacts the surface upon which the user is standing.

As mentioned previously, in some embodiments aspects of the present disclosure include an anti-slip footwear (e.g., an overshoe or a shoe) that includes a sole layer and at least one rotatable traction element rotatably coupled to a lower surface of the sole layer. In some embodiments (e.g., wherein the anti-slip footwear is an anti-slip overshoe), users can attach or secure an anti-slip overshoe to their footwear or feet prior to using an omnidirectional locomotion system, walkable virtual reality (VR) system, etc. In some embodiments (e.g., wherein the anti-slip footwear is an anti-slip shoe), users can attach or secure an anti-slip shoe to their feet prior to using an omnidirectional locomotion system, walkable VR system, etc. (e.g., based on at least the rotatable traction element being integrated with a sole portion of the anti-slip shoe). For example, the rotatable traction element of the anti-slip footwear can be rotated to a first position for decreasing friction between the user's foot and a platform of the omnidirectional locomotion system (e.g., while the user stands, walks, runs on, or otherwise uses a platform of the omnidirectional locomotion system). The rotatable traction element of the anti-slip footwear can be rotated to a second position for increasing friction (e.g., increasing traction) between the user's foot and the platform of the omnidirectional locomotion system while the user is mounting or dismounting the platform. These and other benefits of the presently disclosed anti-slip overshoe will be described in greater depth below with reference to the figures and example embodiments described herein.

FIG. 1 illustrates a perspective view of an example omnidirectional locomotion system 100 (also referred to herein as an "omnidirectional treadmill") with which aspects of the present disclosure may be utilized. In some embodiments, the anti-slip overshoes described herein can be utilized by a user of an omnidirectional locomotion system that is the same as or similar to that described in commonly owned P.C.T. Patent Application PCT/US21/52109, filed Sep. 25, 2021, the contents of which are hereby incorporated by reference. With respect to the example of FIG. 1, omnidirectional locomotion system 100 includes a base portion 110, an articulating arm portion 150, and a coupling portion 160 (also referred to herein as a "spine portion"), each of which will be explained in greater depth below.

In operation, a user may stand on a platform 112, shown here as a concave platform although other geometries, both curved and flat, can be utilized without departing from the scope of the present disclosure. As illustrated, platform 112 and base frame 114 are vertically separated from one another but remain rigidly affixed such that there is no relative rotation between the two. In some embodiments, a central hub or bearing can provide the rigid affixation between platform 112 and base frame 114. The articulating arm portion 150 can extend radially through the area of vertical separation (i.e., the gap) between platform 112 and base frame 114. A first distal end of articulating arm portion 150 can be coupled to a rotatable element of the aforementioned central hub or bearing, such that articulating arm 150 can rotate freely through a full 360° of rotation with respect to a reference or ground plane. In some embodiments, the reference ground plane can be given by base portion 110, platform 112, and/or base frame 114. A second distal end of articulating arm portion 150 is coupled to the spine portion 160, e.g., at a rotating joint 140. As illustrated, articulating arm 150 includes three rotating joints (also referred to herein as "revolute joints" and/or "hinge joints")—a first rotating joint 120, a second rotating joint 130, and a third rotating joint 140—each of which will be described in greater depth below. However, it is appreciated that a greater or lesser number of rotating joints can be utilized without departing from the scope of the present disclosure. For example, in some embodiments a single rotating joint can be utilized, e.g., provided at or near the location where the articulating arm 150 meets the base portion 110. As another example, in some embodiments, two rotating joints can be utilized, e.g., the rotating joints 120 and 130, with the functionality of third rotating joint 140 instead provided by an alternate mechanism such as a sliding rail mechanism upon which the vest is mounted to permit vertical movement of spine assembly 160 and a user.

The user's body or torso can be coupled to omnidirectional locomotion system 100 by a vest or harness worn over the chest/shoulders (not shown). In some embodiments, the user can additionally or alternatively be coupled to omnidirectional locomotion system 100 via a help belt, hip harness, or other attachment means that contact the user at or about the user's waist and/or hips. In such scenarios in which a hip belt, hip harness, etc., are utilized, it is contemplated that the hip belt can be used as a sole attachment means (e.g., without a vest or torso harness), a primary attachment means, and/or a secondary attachment means (e.g., used in combination with a vest or torso harness). In particular, the vest or other attachment mechanism can be mounted to spine portion 160, such that a user wearing the vest is coupled to both spine assembly 160 and the articulating arm 150. Based on various combinations of the 360° rotation permitted by base portion 110 and the multi-point articulation permitted by the three rotating joints 120, 130, 140 and the linkage of articulating arm 150, omnidirectional locomotion system 100 allows users to perform actions that include, but are not limited to, running, jumping, crawling, squatting, bending, etc., over the full 360° of rotation. Unlike conventional approaches to providing locomotion for use in or with virtual reality experiences, a full-ROM omnidirectional locomotion system can avoid the use of physical supports, restraints, or other "real world" hindrances that can severely reduce a user's ability to feel fully immersed in a virtual reality world. In particular, in some embodiments the articulating arm 150 can be viewed as a follower-type linkage—the links and revolute joints 120,130,140 are repositionable such that the user's movement (coupled to articulating arm 150 via spine assembly 160 and a vest/harness attached to the user's torso) drives the linkage and causes articulating arm 150 to "follow" the movements of the user.

Advantageously, compared to conventional solutions for translating real world locomotion into movement within a virtual reality world, the presently disclosed omnidirectional locomotion system allows users to change their direction of movement naturally, e.g., by rotating their hips and torso to walk or run in the desired direction. Existing solutions largely approach the problem of controlling direction of locomotion by setting the direction of locomotion to be the same as (or otherwise corresponding to) the direction of the user's gaze within the virtual reality world. That is, existing solutions require a user to 'look' left in order to walk left, whereas the presently disclosed omnidirectional locomotion system allows a user to walk left by simply turning their body to the left, just as they would do in the real world. Not only is this approach more natural and immersive, but it is also more robust in terms of permitted interaction dynamics within the virtual reality environment—a user can walk to the left while looking over his shoulder (i.e., to the right), an ability that is particularly valuable, for example, in first person shooter and other open world games, where action is often concentrated in areas besides directly in front of the user.

In some examples, the platform 112 included in the omnidirectional locomotion system 100 can be concave circular in shape, with a flattened circular depression at its center. In use, a user of the omnidirectional locomotion system 100 can stand on platform 112 and perform one or more locomotion or movement actions (e.g., walking, stepping, running, jumping, etc., in one or more directions along the 360 degrees of platform 112). For example, a user can stand in or on the flattened circular depression at the center of platform 112 and move forward, backwards, side-to-side, etc. In order to provide a more immersive or realistic locomotion experience, after performing a step or stride movement, the user position can be urged back (e.g., restored) towards the central flattened depression at the center of platform 112. In some aspects, the restoring force can be provided based on a sliding interaction between the user's feet and the curved walls of the concave platform 112.

For instance, the central flattened depression of platform 112 can be disposed at a lower height (e.g., relative to a ground surface upon which the omnidirectional locomotion system 100 is positioned) than the curved wall portions that extend vertically upward from the central flattened depression of platform 112. When a user strides or otherwise performs a locomotion action, the user's foot makes contact with the curved wall portion of platform 112 at a height that is above the central flattened depression—when friction forces between a bottom surface of the user's footwear are sufficiently small, the user's stride foot will slide down the curved wall portion of platform 112 and be restored to the central flattened depression of platform 112, at which point the user can perform subsequent locomotion actions with their stride foot.

In some aspects, the reduction of friction forces between a bottom surface of the user's footwear and the outer surface of the platform 112 can be advantageous during use of the omnidirectional locomotion system 100. For example, a user might be provided with a specialized footwear having a low-friction or friction-reducing bottom sole designed to provide a low-resistance sliding action while a user performs locomotion actions on platform 112. However, the reduction of friction forces at the bottom surface of the user's footwear can be undesirable or dangerous in scenarios in which the user is not actively engaged in performing locomotion actions on platform 112 of omnidirectional locomotion system 100.

For example, while reduced friction forces may be desirable while the user is walking or running on platform 112 of omnidirectional locomotion system 100, reduced friction forces may be undesirable while the user is mounting or stepping onto platform 112 (e.g., transitioning from the flat ground surface upon which the omnidirectional locomotion system 100 is installed onto the concave platform 112) and/or while the user is dismounting or stepping off of platform 112 (e.g., transitioning from the concave platform 112 to the flat ground surface upon which the omnidirectional locomotion system 100 is installed). In some cases, a user wearing a specialized footwear or overshoe that is designed to provide low friction sliding interaction with the platform 112 may be more likely to experience a potentially dangerous slip and fall and/or sustain an injury when attempting to get onto or off of platform 112, particularly given the fact that the concave walls of platform 112 are generally not parallel to the ground plane. For example, users attempting to mount platform 112 often step from the flat ground surface and onto the curved, concave surface of platform 112 (e.g., rather than onto the flat, central depression of platform 112). In such a scenario, if the user is wearing friction-reducing footwear, the user's plant foot will make contact with the curved, concave surface of platform 112 and immediately begin slipping or sliding downwards, towards the flat, central depression of platform 112. While a desired behavior when the user is fully mounted on platform 112 and using omnidirectional locomotion system 100, such a behavior or interaction can be undesirable at all other times. Additionally, a user may install the omnidirectional locomotion system 100 on or about a ground surface that is naturally predisposed to slipping events (e.g., a ground surface such as tile, vinyl flooring, polished concrete, etc., that provides low amounts of traction or friction with the user's foot/footwear).

Accordingly, there is a need for footwear that can provide user-adjustable or user-modifiable traction, such that a user may advantageously benefit from low traction/friction forces once safely standing upon or using platform of an omnidirectional locomotion system (e.g., platform 112) and high traction/friction forces when mounting or dismounting the platform (e.g., and/or at all other times other than when the user is actively performing locomotion movements on the platform).

Figure 2A:
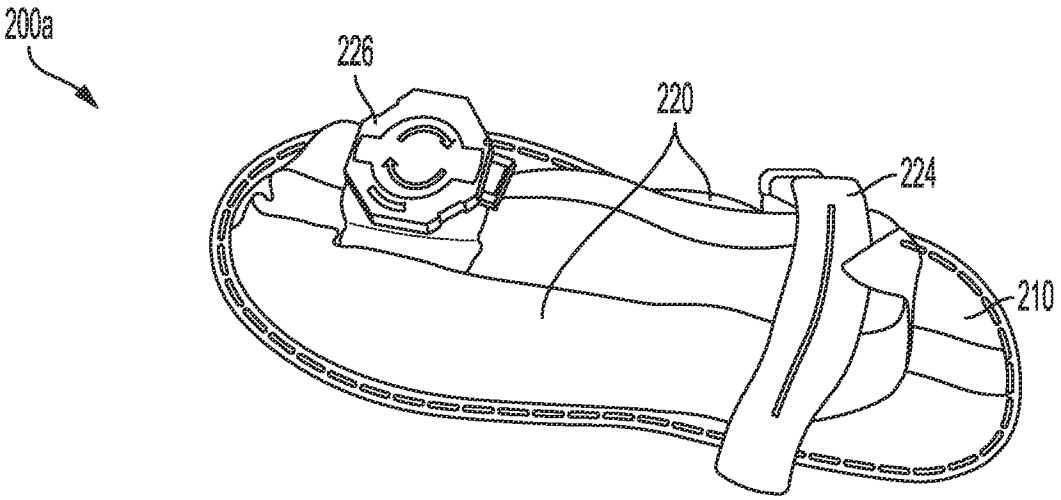
FIG. 2A is a perspective view of an example anti-slip footwear, according to one or more aspects of the present disclosure.
Figure 2B:
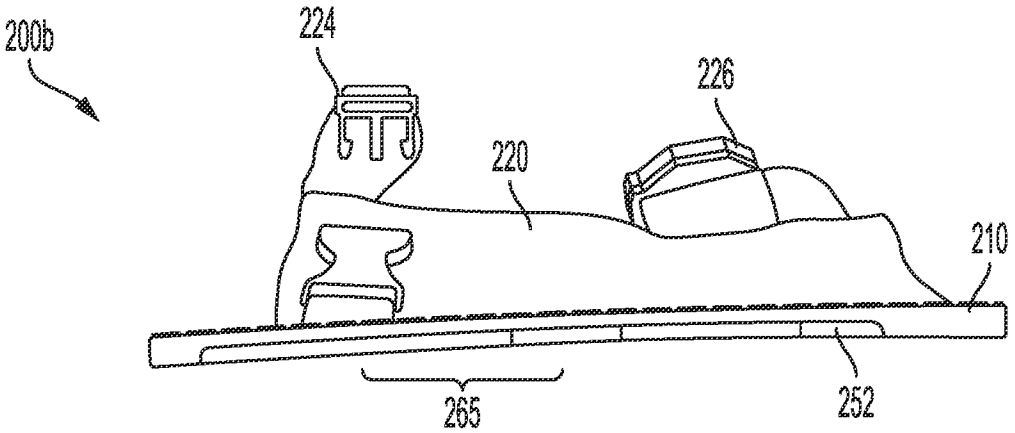
FIG. 2B is a side profile view of an example anti-slip footwear, according to one or more aspects of the present disclosure.

FIGS. 2A and 2B are diagrams illustrating examples of an anti-slip footwear according to aspects of the present disclosure. In particular, FIGS. 2A and 2B depict an example in which the anti-slip footwear is an anti-slip overshoe, although it is noted that the anti-slip footwear may also be provided as an anti-slip shoe without departing from the scope of the present disclosure (e.g., wherein at least a rotatable traction element is integrated with a sole of the anti-slip shoe). FIG. 2A is a diagram depicting a perspective view of an example anti-slip overshoe 200*a* and FIG. 2B is a diagram depicting a side (profile) view of an example anti-slip overshoe 200*b*. In some embodiments, the anti-slip overshoe 200*a* can be the same as or similar to the anti-slip overshoe 200*b*.

In one illustrative example, an anti-slip overshoe (e.g., anti-slip overshoe 200*a* and/or 200*b*) can include a sole layer 210 having an upper surface and a lower surface. The upper surface of sole layer 210 (e.g., visible in the illustration of FIG. 2A) can be configured to receive a user's footwear, shoe, foot, etc. For example, the upper surface of sole layer 210 can include or otherwise be coupled to one or more footwear attachment elements 220, 224, and 226, which are described in greater depth below. In embodiments in which an anti-slip shoe (e.g., rather than an anti-slip overshoe) is provided, the upper surface of sole layer 210 can be included in a sole portion of the anti-slip shoe structure. For example, the upper surface of sole layer 210 can be bonded or attached to one or more additional sole layers that comprise the sole portion of an anti-slip shoe. The lower surface of sole layer 210 (not visible in the illustration of FIG. 2A) can be opposite from the upper surface of sole layer 210, and may be configured to make contact with the ground or other surface upon which a user stands while wearing the anti-slip overshoe 200*a*.

In some embodiments, the presently disclosed anti-slip overshoe (e.g., such as anti-slip overshoes 200*a* and/or 200*b*) can be sized to receive and secure an outer surface of a user's footwear. As contemplated herein, a user's footwear can include a shoe or other apparatus worn on the foot and may additionally include a user's bare or socked foot. For example, the sizing of the presently disclosed anti-slip overshoe can be larger than the sizing of the user's footwear, such that the anti-slip overshoe can receive the user's footwear and be securely attached to an outer surface of the user's footwear. In some embodiments, a pair of anti-slip overshoes (e.g., one for each foot) can include a left anti-slip overshoe and a right anti-slip overshoe and/or in some embodiments, a given anti-slip overshoe can be configured to provide a universal fit for left or right feet (e.g., a pair of anti-slip overshoes may include a dedicated left and right anti-slip overshoe or may include two identical anti-slip overshoes each of which can be worn on a left or a right foot).

As mentioned previously, the upper surface of sole layer 210 can include or otherwise be coupled to one or more footwear attachment elements 220, 224, and 226 for securing the anti-slip overshoe 200*a* to an outer surface of the user footwear. For example, the upper surface of sole layer 210 can include or otherwise be coupled to a rear strap portion 224 (e.g., a heel strap portion), side strap portion(s) 220, and/or a front strap portion 226 (e.g., a toe strap portion). In some aspects, some, or all, of the footwear attachment elements 220, 224, 226 can comprise an elastic material that elastically deforms when a user's footwear is received in the anti-slip overshoe 200*a* (e.g., securing the user's footwear to sole layer 210 based at least in part on the compressive force exerted by the elastic material when stretched by the outer surface of the user's footwear).

In some aspects, one or more, or all, of the footwear attachment elements 220, 224, 226 may be adjustable to provide a customizable or improved fit about the outer surface of a user's footwear. For example, the heel strap portion 224 can include a buckle (e.g., seen in FIG. 2B) or other adjustment mechanism that permits a user to change the length, and therefore fit, of the heel strap portion 224 when secured (e.g., buckled) over the outer surface of the user's footwear. The toe strap portion 226 can include a tensioning mechanism that can tighten or loosen about the outer surface of the user's footwear. For example, the toe strap portion 226 can be tightened by rotating the tensioning mechanism to decrease an effective length of the strap running orthogonal to the longitudinal axis of the sole layer 210, wherein the longitudinal axis extends from the heel portion of sole layer 210 to toe portion of sole layer 210. Similarly, the toe strap portion 226 can be loosened by rotating the tensioning mechanism to increase an effective length of the strap running orthogonal to the longitudinal axis of the sole layer 210. It is noted that the footwear attachment elements 220, 224, and 226 (and the associated tension mechanisms, adjustment mechanisms, etc.) are described for purposes of example and illustration and are not intended to be construed as limiting.

FIG. 2B depicts a profile (e.g., side) view of an example anti-slip overshoe 200*b* according to aspects of the present disclosure. In some embodiments, the example anti-slip overshoe 200*b* depicted in FIG. 2B can be the same as or similar to the example anti-slip overshoe 200*a* depicted in FIG. 2A. As illustrated, the sole layer 210 can be coupled to the footwear attachment elements 220, 224, and 226. In some examples, sole layer 210 can be rigidly affixed to the footwear attachment elements 220, 224, 226 via one or more threads or other binding elements. For instance, sole layer 210 can include a plurality of openings disposed about an outer perimeter of the upper and lower surfaces of sole layer 210 (e.g., as may be seen in FIGS. 4A and 4B). Using the plurality of perimeter openings passing through the upper and lower surfaces of sole layer 210, one or more (or all) of the footwear attachment elements 220, 224, 226 may be sewn to sole layer 210.

In some aspects, sole layer 210 can be provided as a single piece construction, in which the upper and lower surfaces of sole layer 210) comprise a single, integrally molded piece. In some aspects, sole layer 210 can be provided as a multi-piece construction, for example in which the upper and lower surfaces of sole layer (and/or one or more intermediate layers disposed between the upper and lower surfaces of sole layer 210) are provided as individual or discrete components. When sole layer 210 is a multi-piece construction, the constituent layers or components of sole layer 210 can be bonded or otherwise attached to one another using various approaches as would be appreciated by one of ordinary skill in the art.

In one illustrative example, the anti-slip overshoe disclosed herein (e.g., such as anti-slip overshoes 200*a*, 200*b*) can include one or more rotatable traction portions that are rotatably coupled to the lower surface of the sole layer (e.g., such as the lower surface of sole layer 210). For example, an anti-slip overshoe can include at least one rotatable traction portion that is disposed on the lower surface of the sole layer and is rotatable through approximately 180 degrees. In some embodiments, the approximate 180-degree rotation can allow a user to rotate the rotatable traction portion between a first position in which a relatively low friction/traction surface of the rotatable traction portion faces downward and makes contact with the surface upon which the user stands and a second position in which a relatively high friction/traction surface of the rotatable traction portion faces downward and makes contact with the surface upon which the user stands. Additional details relating to the rotatable traction portion(s) that may be included in the presently disclosed anti-slip overshoe will be described in greater depth below with respect to the rotatable traction portion 450 illustrated in FIG. 4A and the rotatable traction portion 550 illustrated in FIGS. 5A-D.

In some embodiments, the rotatable traction portion can be rotatable (e.g., by a user wearing the presently disclosed anti-slip overshoe) between the first, low friction position and the second, high friction position wherein the rotatable traction portion rotates about an axis of rotation that is orthogonal (e.g., perpendicular) to a longitudinal axis extending from the heel portion of the sole layer to a toe portion of the sole layer. In some embodiments, the axis of rotation associated with the rotatable traction portion can be disposed proximate to a toe portion of the sole layer of the anti-slip overshoe. For example, the axis of rotation associated with the rotatable traction portion can be disposed adjacent to or at the ball of the user's foot (e.g., when the user's foot is received in the anti-slip overshoe). In some aspects, the axis of rotation associated with the rotatable traction portion can be located such that the rotatable traction portion, when in the second, relatively high friction position, is disposed adjacent to or at the ball of the user's foot (e.g., as illustrated in FIGS. 4A and 5A-D).

Figure 3B:
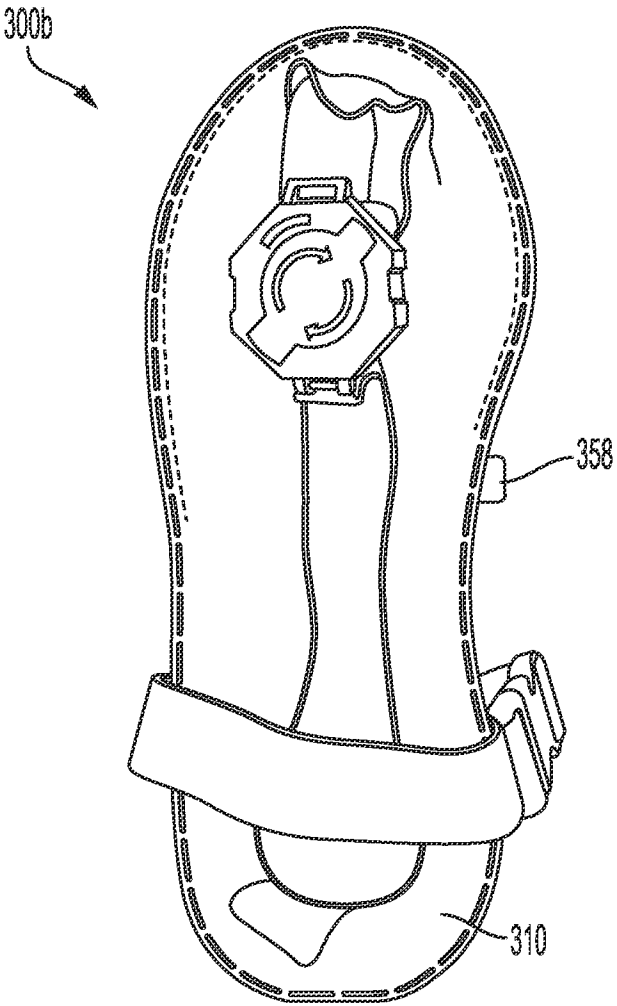
FIG. 3B is a top-down view of an example anti-slip footwear including at least one actuation element coupled to a rotatable traction portion of the example anti-slip footwear, according to one or more aspects of the present disclosure.
Figure 3A:
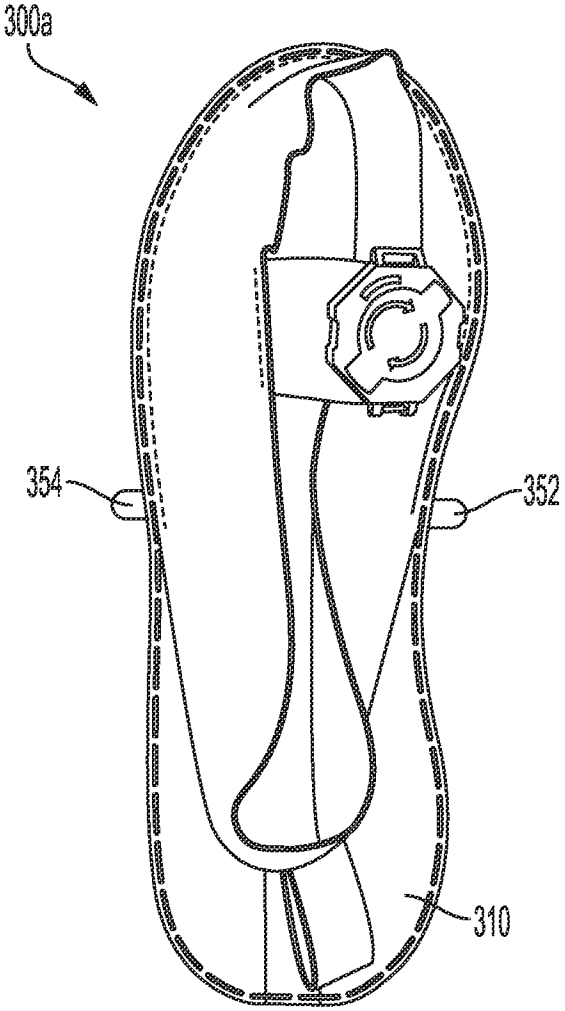
FIG. 3A is a top-down view of an example anti-slip footwear including at least two actuation elements coupled to a rotatable traction portion of the example anti-slip footwear, according to one or more aspects of the present disclosure.

In one illustrative example, the rotatable traction portion can include one or more actuation elements for rotating the rotatable traction portion between the first (e.g., low friction) position and the second (e.g., high friction) position. For example, the one or more actuation elements can comprise a tab that is coupled to or integrally formed with the rotatable traction portion and extends from the rotatable traction portion in a direction orthogonal to the longitudinal axis of the sole layer. For example, FIGS. 3A and 3B are diagrams illustrating top-down views of example anti-slip footwears 300*a* and 300*b*, respectively. In one illustrative example, anti-slip footwear 300*a* and/or anti-slip footwear 300*b* can be provided as an anti-slip overshoe, although it is also contemplated that footwear 300*a* and/or footwear 300*b* may also be provided as an anti-slip shoe, without departing from the scope of the present disclosure (e.g., wherein at least a rotatable traction element is integrated with a sole of the anti-slip shoe). In both FIGS. 3A and 3B, the longitudinal axis of the sole layer 310 extends vertically, from the heel portion of sole layer 310 to the toe portion of sole layer 310.

In the example of anti-slip overshoe 300*a* illustrated in FIG. 3A, the example anti-slip overshoe 300*a* includes a first actuation element 352 and a second actuation element 354, wherein both of the actuation elements 352, 354 extend beyond an outer edge of the sole layer 310 both when the rotatable traction element is in the first, low-friction position and when the rotatable traction element is in the second, high-friction position. As illustrated, the first and second actuation elements 352, 354 can be provided on opposite sides of sole layer 310. For example, as illustrated in FIG. 3A, first actuation element 352 can be provided at an inner side of sole layer 310 (e.g., towards the big toe) and second actuation element 354 can be provided at an outer side of sole layer 310 (e.g., towards the pinkie toe).

In some aspects, the width of the sole layer 310 varies along the longitudinal axis of sole layer 310 (e.g., based on the human foot being narrower at the heel than at the instep/ball of the foot and at the toes. In some embodiments, the actuation elements 352, 354 can extend beyond the outer edge of the sole layer 310 even given the varying width of sole layer 310 along its longitudinal axis. In some examples, the actuation elements 352, 354 can be disposed at the same longitudinal position along the longitudinal axis of the sole layer 310 (e.g., an imaginary line extending through the first actuation element 352 can also pass through or extend through the second actuation element 354). In some embodiments, the first actuation element 352 can be offset (e.g., in the longitudinal direction along the longitudinal axis of sole layer 310) relative to the second actuation element 354.

In the example of anti-slip overshoe 300*b* illustrated in FIG. 3B, the example anti-slip overshoe 300*b* includes a single actuation element 358. For example, FIG. 3B depicts the single actuation element 358 as being provided on the inner side of sole layer 310 (e.g., the side closer to the big toe). As described above with respect to FIG. 3A and the dual actuation elements 352, 354, the single actuation element 358 illustrated in FIG. 3B can extend beyond the edger of sole layer 310 both when the rotatable traction element (e.g., to which the single actuation element 358 extends, is coupled to, is integrally formed with, etc.) is in the first, low-friction position and when the rotatable traction element is in the second, high-friction position. In some aspects, although the single actuation element 358 is depicted as being provided along the inner side of sole layer 310, the single actuation element 358 may alternatively be provided along the outer side of sole layer 310 (e.g., along the side of sole layer 310 that is closer to the user's pinkie toe). In some examples, the single actuation element 358 can be disposed at a longitudinal position (e.g., along the longitudinal axis of sole layer 310) that approximately corresponds to the location of the ball of the user's foot when received in the anti-slip overshoe 300*b*. In some examples, the single actuation element 358 can be disposed at a longitudinal position along the longitudinal axis of sole layer 310 such that the second, high-friction position of the rotatable traction element to which single actuation element 358 is coupled approximately corresponds to the location of the ball of the user's foot when received in the anti-slip overshoe 300*b*.

In some embodiments, the one or more actuation elements (e.g., the dual actuation elements 352, 354 illustrated in FIG. 3A and/or the single actuation element 358 illustrated in FIG. 3B) can comprise a tab or lever that is integrally formed with the rotatable traction portion included on the lower surface of the presently disclosed anti-slip overshoe. In some aspects, the one or more actuation elements can be approximately coplanar with the rotatable traction portion. Based at least in part on the actuation elements or tabs extending beyond the outer edge of the sole layer (e.g., extending beyond the inner or outer side edge of sole layer 310), the actuation elements or tabs can be engaged by a user of the anti-slip overshoe to cause a rotation of the rotatable traction portion between the first, low-friction position and the second, high-friction position. In some aspects, the actuation elements or tabs can be actuated to rotate the rotatable traction portion based on the user using the opposite foot to step on or push the actuation element/tab. For example, FIG. 3B depicts the single actuation element 358 (e.g., tab or lever) positioned on the inner side of the left-foot anti-slip overshoe 300*b*— while wearing anti-slip overshoe 300*b*, a user can engage the single actuation element 358 (e.g., on the left-foot anti-slip overshoe 300*b*) by stepping on or pushing the single actuation element 358 with their hand, fingers, right foot, etc. In some aspects, the actuation element(s) included on the presently disclosed anti-slip overshoe(s) can be engaged to rotate the rotatable traction portion based on the user pressing the actuation element against a rigid surface (e.g., such as the platform 112 of example omnidirectional locomotion system 100) to cause the rotation of the rotatable traction portion between the first, low-friction position and the second, high-friction position and vice versa.

In some embodiments, the actuation elements or tabs of the rotatable traction portion can have an approximately equal thickness as the rotatable traction portion. In some embodiments, the actuation elements or tabs can have a lesser thickness than that of the rotatable traction portion, such that the actuation elements or tabs do not make ground contact when the rotatable traction portion is in the first, low-friction position, the second, high-friction position, or both.

In one illustrative example, the one or more actuation elements or tabs included in a given rotatable traction portion can be disposed opposite from the rotation axis of the rotatable traction portion. For example, FIG. 4A is a diagram illustrating a bottom view of the lower surface of a sole layer 410 included in an example anti-slip footwear 400*a*. The example anti-slip footwear 400*a* is depicted as an overshoe, although it is also contemplated that the example anti-slip footwear 400*a* may also be provided as an anti-slip shoe without departing from the scope of the present disclosure (e.g., wherein at least rotatable traction portion 450 is integrated with a sole of the anti-slip shoe) As illustrated, the example anti-slip overshoe 400*a* includes a rotatable traction portion 450 with an axis of rotation that is orthogonal to the longitudinal axis of sole layer 410 and wherein the rotatable traction portion 450 includes an actuation element/tab 452 that is disposed opposite from the rotation axis of rotatable traction portion 450.

Figure 4B:
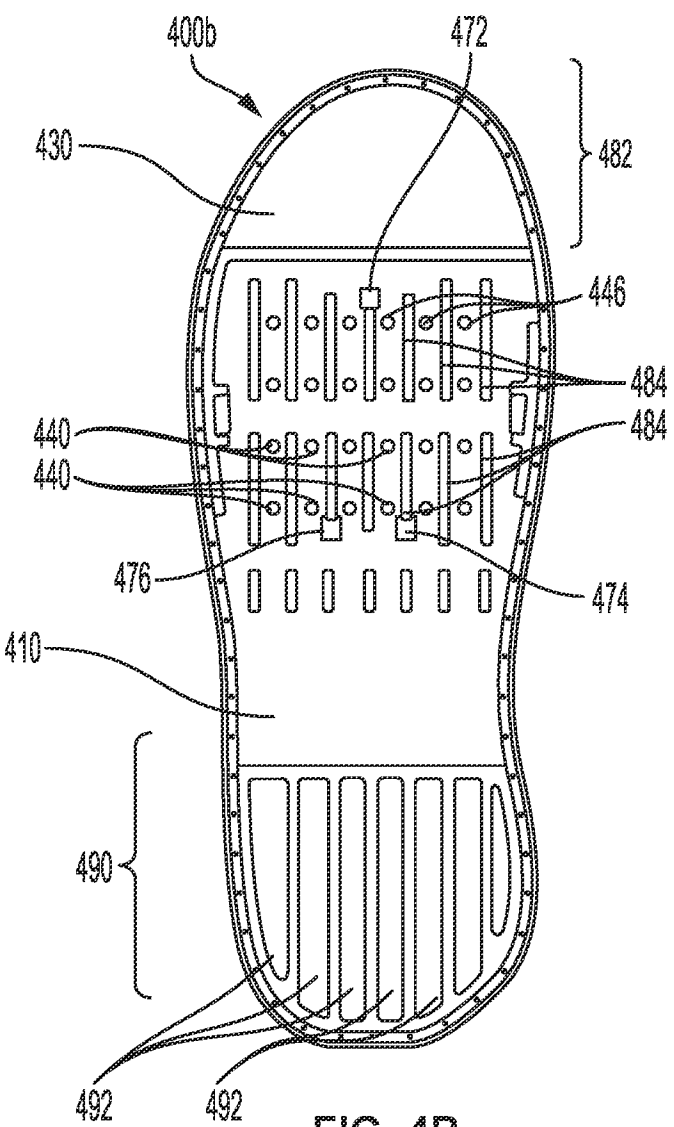
FIG. 4B is a bottom view of a lower surface of a sole layer included in the example anti-slip footwear depicted in FIG. 4A, according to one or more aspects of the present disclosure.
Figure 4A:
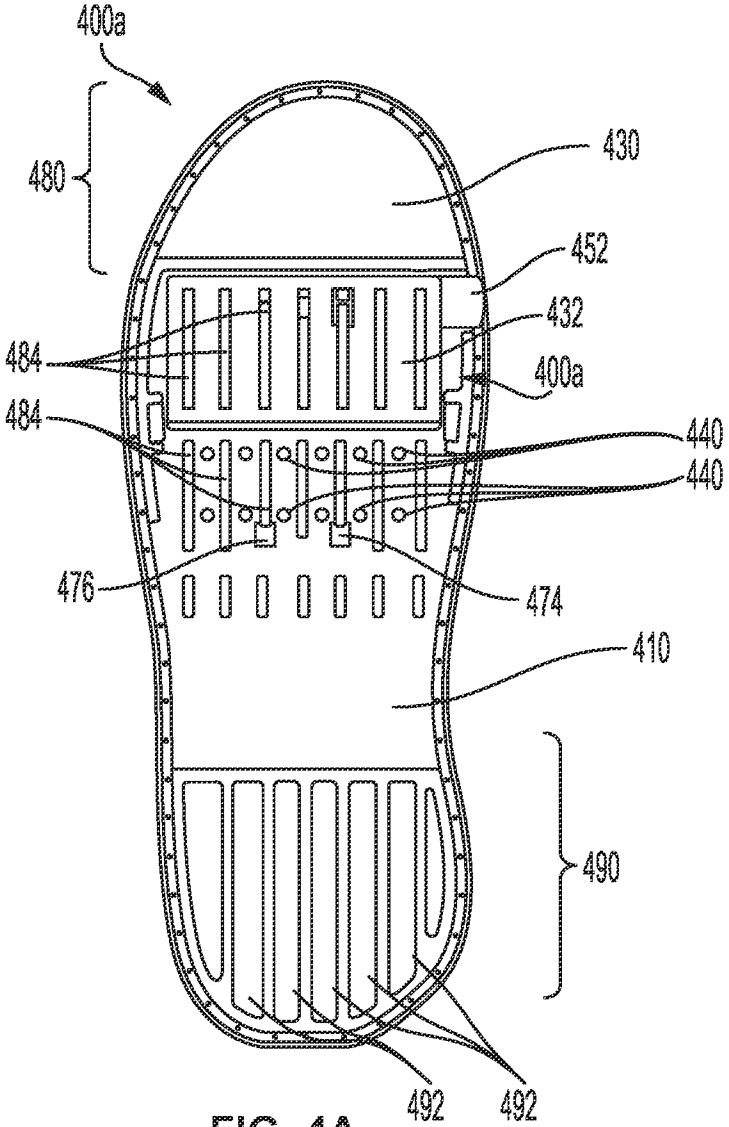
FIG. 4A is a bottom view of a lower surface of an example anti-slip footwear, according to one or more aspects of the present disclosure.

FIG. 4B is a diagram illustrating a bottom view of the lower surface of a sole layer 410 included in an example anti-slip footwear 400*b*, which may be the same as or similar to the example anti-slip overshoe 400*a*. Similarly, the example anti-slip footwear 400*b* is depicted as an overshoe, although it is also contemplated that the example anti-slip footwear 400*a* may also be provided as an anti-slip shoe without departing from the scope of the present disclosure (e.g., in which a rotatable traction portion is integrated with a sole of the anti-slip shoe). In some examples, the anti-slip overshoe 400*b* can be the same as the anti-slip overshoe 400*a*, wherein the anti-slip overshoe 400*b* is depicted in FIG. 4B without the rotatable traction portion 450 (e.g., FIG.

4B may be seen to depict the same view as FIG. 4A, with the rotatable traction portion 450 moved/not shown).

The anti-slip overshoe 400*a*, 400*b* includes a toe portion 480 and a heel portion 490. A longitudinal axis of the anti-slip overshoe (and the sole layer 410) extends through the toe portion 480 and the heel portion 490. In some embodiments, the toe portion 480 can include one or more friction pads 430, which increase the friction between the user's foot (e.g., as received within anti-slip overshoe 400*a*, 400*b*) and a surface upon which the user is standing (e.g., platform 112 of omnidirectional locomotion system 100). The friction pad(s) 430 can be integrally formed with sole layer 410 and/or can be coupled to sole layer 410. For example, if friction pad(s) 430 are integrally formed with sole layer 410, the coefficient of friction between friction pad(s) 430 and platform 112 can be increased based on a material selection used to form friction pad(s) 430 and/or based on a finishing process applied to friction pad(s) 430 (e.g., wherein the finishing process increases the roughness of the surface of friction pad(s) 430). In examples wherein friction pad(s) 430 are coupled to sole layer 410, the friction pad(s) 430 may comprise a different material than the sole layer 410, wherein the material used to form friction pad(s) 430 provides greater traction (e.g., a greater coefficient of friction) than the different material used to form sole layer 410.

The sole layer 410 can include one or more friction reducing elements for providing low-friction interaction between the user's feet and a surface upon which the user is standing or moving (e.g., platform 112 of omnidirectional locomotion system 100). In some embodiments, the one or more friction reducing elements can have a first coefficient of friction with a platform of an omnidirectional locomotion system (e.g., such as platform 112 of omnidirectional locomotion system 100). In some aspects, the friction pad(s) 430 can have a coefficient of friction with the platform of the omnidirectional locomotion system that is greater than the first coefficient of friction that is associated with the one or more friction reducing elements. In some embodiments, the sole layer 410 can include a plurality of rib elements for providing low-friction interaction between the user's feet and a surface upon which the user is standing or moving (e.g., some or all of the friction reducing elements can be rib elements). In some aspects, the lower surface of sole layer 410 (e.g., depicted in the perspective of FIGS. 4A and 4B) can include a plurality of parallel rib elements that run along (e.g., are parallel to) the longitudinal axis of sole layer 410. However, it is noted that various other shapes, sizes, geometric configurations and arrangements, etc., of the plurality of rib elements disposed on the lower surface of sole layer 410 may also be utilized without departing from the scope of the present disclosure. As illustrated, the plurality of rib elements 484 can extend orthogonally from the lower surface of sole layer 410, such that the distal faces of the rib elements 484 make contact with the surface upon which the user wearing anti-slip overshoe 400*a* is standing (e.g., platform 112 of omnidirectional locomotion system 100). In some embodiments, the plurality of rib elements 484 can be integrally formed with sole layer 410 and/or can be integrally formed with at least the lower surface of sole layer 410. In some examples, the plurality of rib elements 484 may extend from the lower surface of sole layer 410 by an equal amount, such that the distal faces of the rib elements 484 all make contact with the surface upon which the user is standing (e.g., when the anti-slip overshoe 400*a* is oriented in a flat orientation relative to the surface upon which the user is standing).

In some embodiments, the one or more friction reducing elements (e.g., the plurality of rib elements 484) can have an equal width and/or can be equally spaced along the width of the sole layer 410. In some embodiments, a spacing between adjacent ones of the plurality of rib elements 484 can be approximately equal to the width of the portions of rotatable traction element 450 that are received between the adjacent rib elements 484 when the rotatable traction element 450 is in either the first, low friction position or is in the second, high friction position that is depicted in FIG. 4A.

The rotatable traction element 450 can include a plurality of slot openings that are substantially parallel to the one or more friction reducing elements (e.g., substantially parallel to the plurality of rib elements 484) and/or the longitudinal axis of the sole layer 410. The plurality of slot openings can be sized, in at least the longitudinal and width dimensions of sole layer 410 as illustrated in FIGS. 4A and 4B, to each receive a corresponding one of the rib elements 484. For example, the plurality of slot openings included in the rotatable traction element 450 can have a width (e.g., orthogonal to the longitudinal axis of sole layer 410) that is greater than or equal to the width of the individual rib elements 484, such that the rotatable traction element 450 can lay approximately flush with the plurality of rib elements 484 when rotated into either the first, low-friction position or the second, high-friction position illustrated in FIG. 4A.

In some embodiments, the presently disclosed anti-slip overshoe can include one or more locking mechanisms for securing the rotatable tracking portion in either the first, low-friction position or the second, high-friction position. For example, as illustrated in FIGS. 4A and 4B, the anti-slip overshoes 400*a*, 400*b* (respectively) can include a plurality of magnets 440 that are coupled to or integrated with the sole layer 410. Based on the rotatable traction portion 450 comprising a magnetic material (e.g., such as steel), the rotatable traction portion 450 can be locked or secured in either the first, low-friction position or the second, high-friction positioned based on the magnetic force between the plurality of magnets 440 and the magnetic material used to form rotatable traction portion 450. In some embodiments, the magnetic arrangement between sole layer 410 and rotatable traction portion 450 can be reversed, e.g., with the rotatable traction portion 450 comprising or including one or more magnets, being formed from a ferromagnetic material, etc., and the sole layer 410 including one or more magnetic materials such as steel.

As illustrated, the plurality of magnets 440 can be disposed in the channels between adjacent ones of the plurality of rib elements 484 that extend from the lower surface of sole layer 410. In some embodiments, at least one magnet can be disposed in each channel that is formed between adjacent ones of the rib elements 484. For example, FIGS. 4A and 4B depict a configuration in which two circular magnets are disposed in each channel between adjacent ones of the plurality of rib elements 484. However, it is noted that a greater or less quantity of magnets, a different size of magnets, and/or a different shape of magnets, etc., may also be utilized to provide one or more (or all) of the plurality of magnets 440 without departing from the scope of the present disclosure. In some embodiments, a magnet may not be provided in which one of the channels formed between adjacent rib elements 484, as is illustrated. For instance, in some aspects, one or more magnets may be provided in every other channel, every third channel, etc. In some examples, the plurality of magnets 440 may be asymmetrical distributed amongst the plurality of channels formed between the adjacent ones of the rib elements 484. For example, one or more magnets may be provided in each channel located at or near the center of rotatable traction portion 450, and transition to being provided in every other, or every third channel, away from the center of rotatable traction portion 450, etc. In some embodiments, one or more (or all) of the plurality of circular magnets 440 depicted in FIGS. 4A and 4B may be replaced with one or more bar magnets or rectangular magnets. In some aspects, a bar magnet or rectangular magnet may be disposed such that the bar magnet extends, in width, across multiple ones of the channels formed between adjacent rib elements 484 (e.g., the bar or rectangular magnet can be positioned to be flush with sole layer 410 and/or to run underneath one or more of the rib elements 484).

In some embodiments, the presently disclosed anti-slip overshoe can include one or more mechanical locking mechanisms for securing the rotatable traction portion in either the first, low-friction position or the second, high-friction position. The one or more mechanical locking mechanisms can be provided in addition to the magnetic locking mechanism described above with respect to the plurality of magnets 440 and/or can be provided as an alternative to the magnetic locking mechanism described above. For instance, the sole layer 410 can include one or more receptacles for receiving a corresponding one or more hooks provided on the distal end of the rotatable traction portion 450 (e.g., the end of the rotatable traction portion that is opposite from the axis of rotation). As illustrated, one or more receptacles can be provided on sole layer 410 to receive a corresponding one or more hooks located on the first, high-friction surface of rotatable traction portion 450 (e.g., when the rotatable traction portion is in the first, low-friction position), and one or more receptacles can be provided on sole layer 410 to receive a corresponding one or more hooks located on the second, low-friction surface of rotatable traction portion 450 (e.g., when the rotatable traction portion 450 is in the second, high-friction position as illustrated in FIG. 4A).

In some embodiments, the sole layer 410 can include a single receptacle 472 for receiving a corresponding single hook located on the second, low-friction surface of rotatable traction portion 450 when the rotatable traction portion 450 is in the first, high-friction position illustrated in FIG. 4A. In some examples, the sole layer 410 can include two or more receptacles 474, 475 for receiving a corresponding two or more hooks located on the first, high-friction surface of rotatable traction portion 450 when rotatable traction portion 450 is in the second, low-friction position. In some embodiments, one or more (or all) of the hook receptacles 472, 474, and/or 476 can disposed at an offset relative to the center longitudinal line of sole layer 410. For example, as illustrated in FIGS. 4A and 4B, the receptacles 474 and 476 are disposed at an offset relative to the center longitudinal line of sole layer 410, while the receptacle 472 is disposed along (e.g., at a zero-offset relative to) the center longitudinal line of sole layer 410.

FIGS. 5A-5D are diagrams illustrating perspective views 500*a*-500*d*, respectively, of an example anti-slip footwear 500. In some embodiments, the anti-slip footwear 500 can be the same as or similar to one or more of the anti-slip overshoes described previously with respect to FIGS. 2A-4B. Similarly, while the anti-slip footwear 500 is depicted as an anti-slip overshoe, it is also contemplated that the anti-slip footwear 500 may be provided as an anti-slip shoe without departing from the scope of the present disclosure (e.g., wherein the rotatable traction portion 550 is integrated with a sole of the anti-slip shoe). As illustrated, FIGS. 5A-5D depict the lower surface (e.g., which makes contact with a surface upon which the user is standing, such as the platform 112 of omnidirectional locomotion system 100) of the sole layer 510 of the example anti-slip overshoe 500. As illustrated, the example anti-slip overshoe 500 includes a sole layer 510 having a fixed friction pad 530 located at a toe portion of the sole layer 510 and further includes one or more friction reducing elements coupled to or integrally formed with the lower surface of sole layer 510. In some embodiments, the one or more friction reducing elements can have a first coefficient of friction with a platform of an omnidirectional locomotion system (e.g., such as platform 112 of omnidirectional locomotion system 100. In some aspects, some (or all) of the one or more friction reducing elements can be provided as a plurality of rib elements 584 that are coupled to or integrally formed with the lower surface of sole layer 510. In some embodiments, one or more (or both) of the fixed friction pad 530 and the plurality of rib elements 584 can be the same as, or similar to, the fixed friction pad 430 and the plurality of rib elements 484, respectively, that are illustrated in and described above with respect to FIGS. 4A and 4B.

A rotatable traction portion 550 can be rotatable between a first, low-friction position (e.g., illustrated in FIG. 5C) in which a second, low-friction face of the rotatable traction portion 550 is facing downward to make contact with the surface upon which the user stands, and a second, high-friction position (e.g., illustrated in FIG. 5A) in which a first, high-friction face of the rotatable traction portion 550 is facing downward to make contact with the surface upon which the user stands. As illustrated, the rotatable traction portion 550 can include one or more actuation mechanisms such as lever 552 for permitting or enabling a manual user rotation of the rotatable traction portion 550 between the first, low-friction position illustrated in FIG. 5C and the second, high-friction position illustrated in FIG. 5A. A plurality of magnets 540 can be disposed on, coupled to, or integrated with the sole layer 510 for locking or otherwise securing the rotatable traction portion 550 in either the first, low-friction position or the second, high-friction position. In some embodiments, the plurality of magnets 540 can be the same as or similar to the plurality of magnets 440 described above.

Figure 5B:
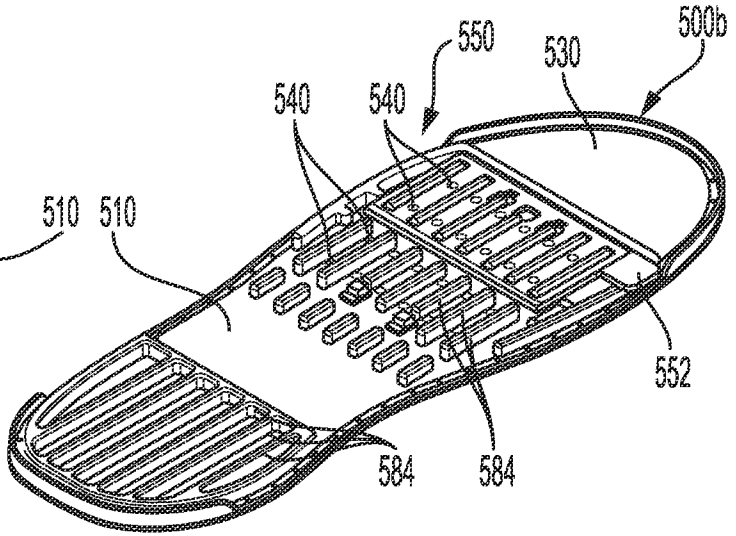
FIG. 5B is another perspective view of a lower surface of an example anti-slip footwear including a rotatable traction portion disposed in a high-friction position, according to one or more aspects of the present disclosure.
Figure 5A:
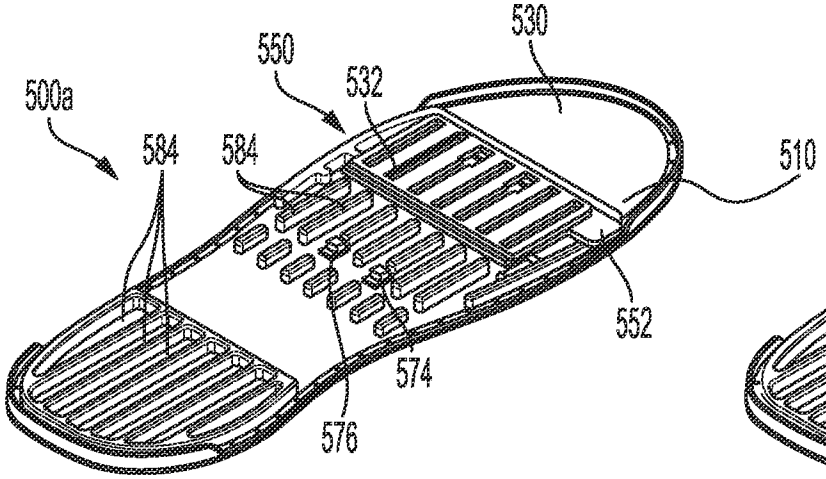
FIG. 5A is a perspective view of a lower surface of an example anti-slip footwear including a rotatable traction portion disposed in a high-friction position, according to one or more aspects of the present disclosure.
Figure 5D:
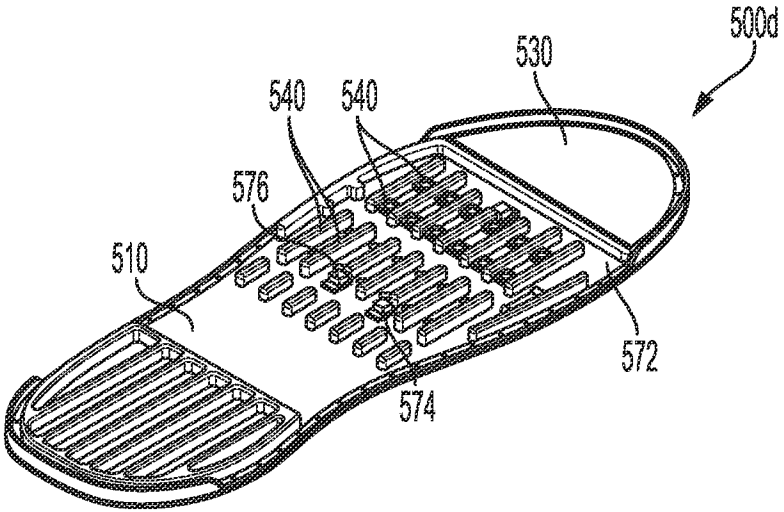
FIG. 5D is a perspective view of the lower surface of a sole layer included in an example anti-slip footwear, according to one or more aspects of the present disclosure.

In one illustrative example, the rotatable traction portion 550 includes a first face that provides relatively greater friction/traction than a second face included on the opposite side of rotatable traction portion 550. For example, FIG. 5A depicts the rotatable traction portion 550 in the second position, wherein a first face 532 of rotatable traction portion 550 is facing downward and makes contact with the surface upon which the user of anti-slip overshoe 500 is standing. In one illustrative example, the first face 532 of rotatable traction portion 550 can be the same as or similar to the friction pad 530 that is permanently affixed to the toe portion of sole layer 510. For example, the first face 532 of rotatable traction portion 550 may also comprise a same or similar friction pad, such that contact between the friction pad of first face 532 and the platform 112 of omnidirectional locomotion system 100 results in an increased friction force/increased traction at the user's foot. In some embodiments, the first face 532 of rotatable traction portion 550 can comprise a friction pad having an approximately equal surface area as the rotatable traction portion 550. In some examples, the first face 532 of rotatable traction portion 550 can comprise a friction pad having a surface area that is greater than the surface area of rotatable traction portion 550. In one illustrative example, the first face 532 of rotatable traction portion 550 can include one or more friction pads each having a second coefficient of friction with a platform of an omnidirectional treadmill (e.g., platform 112 of omnidirectional treadmill 100), wherein the second coefficient of friction is greater than the first coefficient of friction (e.g., associated with the one or more friction reducing elements/rib elements 584 that are coupled to or integrally formed with the lower surface of sole layer 510, as described above).

Figure 5C:
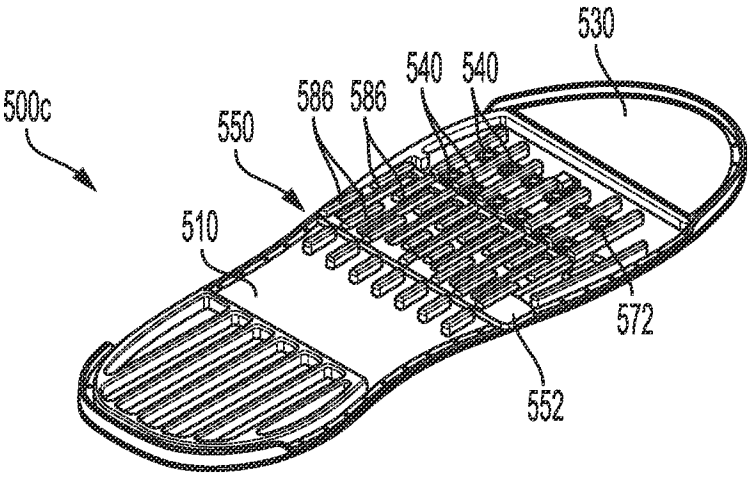
FIG. 5C is a perspective view of the lower surface of the example anti-slip footwear depicted in FIG. 5A, with the rotatable traction portion disposed in a low-friction position, according to one or more aspects of the present disclosure.

In some embodiments, the rotatable traction portion 550 includes a second face that provides a relatively lesser friction/traction than the first face 532. For example, FIG. 5C depicts the rotatable traction portion 550 in the first position, wherein a second face of rotatable traction portion 550 (e.g., opposite to the first face 532) is facing downward and makes contact with the surface upon which the user of anti-slip overshoe 500 is standing. In one example, the second face of rotatable traction portion 550 can include a second set of rib elements (e.g., a second plurality of rib elements) that are the same as or similar the first set of rib elements 584 that are affixed to or otherwise extend from the lower surface of sole layer 510. For example, the second face of rotatable traction portion 550 may also comprise a set of rib elements 586 that are parallel to and/or the same width and height as the set of rib elements 584, such that contact between the second set of rib elements 586 and the platform 112 of omnidirectional locomotion system 100 results in a decreased friction force/decreased traction at the user's foot. In some embodiments, the second face of rotatable traction portion 550 can comprise a second set of rib elements 586 having an approximately equal surface area as the first set of rib elements 584 extending from or integrally formed with the lower surface of sole layer 510. In some examples, the second face of rotatable traction portion 500 can comprise a second set of rib elements 586 having a surface area that is greater than or less than the surface area of the first set of rib elements 584.

What is claimed is:

1. An anti-slip footwear comprising:

a sole layer having an upper surface and a lower surface, wherein the lower surface includes one or more friction reducing elements comprising one or more raised contact elements made of a first material having a first coefficient of friction selected to reduce friction with a platform of an omnidirectional treadmill; and a rotatable traction portion rotatably coupled to the lower surface of the sole layer, the rotatable traction portion being rotatable to expose a first face or a second face, wherein the first face includes one or more friction pads made of a second material having a second coefficient of friction selected to increase friction with the platform of the omnidirectional treadmill, the second coefficient of friction is greater than the first coefficient of friction when is contact with the platform, and the second face includes one or more friction pads comprising one or more raised contact elements made of the first material to reduce friction with the platform of the omnidirectional treadmill.

2. The anti-slip footwear of claim 1, wherein the second coefficient of friction associated with the one or more friction pads is greater than a coefficient of friction associated with the lower surface of the sole layer.

3. The anti-slip footwear of claim 1, wherein the rotatable traction portion is rotatable between a first position in which the first face is disposed adjacent to the lower surface of the sole layer and a second position in which the second face is disposed adjacent to the lower surface of the sole layer.

4. The anti-slip footwear of claim 3, wherein:

the one or more friction pads included on the first face of the rotatable traction portion are substantially coplanar with at least a portion of the lower surface of the sole layer when the rotatable traction portion is in the second position.

5. The anti-slip footwear of claim 3, wherein:

the one or more friction pads included on the first face of the rotatable traction portion are substantially coplanar with at least a portion of the one or more friction reducing elements included on the lower surface of the sole layer when the rotatable traction portion is in the second position.

6. The anti-slip footwear of claim 3, wherein the rotatable traction portion includes a plurality of openings for receiving the one or more friction reducing elements included on the lower surface of the sole layer when the rotatable traction portion is in the first position or the second position.

7. The anti-slip footwear of claim 6, wherein:

the plurality of openings are disposed on the rotatable traction portion such that the plurality of openings are parallel with the one or more friction reducing elements included on the lower surface of the sole layer; and each opening of the plurality of openings has a width that is greater than or equal to a width of the friction reducing elements included on the lower surface of the sole layer.

8. The anti-slip footwear of claim 3, wherein:

a toe portion of the lower surface of the sole layer includes a fixed friction pad; and the one or more friction pads of the first face of the rotatable traction portion are substantially coplanar with the fixed friction pad of the sole layer when the rotatable traction portion is in the second position.

9. The anti-slip footwear of claim 3, wherein:

the rotatable traction portion further includes one or more ferromagnetic materials; and the sole layer further includes one or more magnets for locking the rotatable traction portion in the first position or the second position.

10. The anti-slip footwear of claim 3, wherein:

the first face of the rotatable traction portion further includes one or more first hooks for latching engagement with a corresponding one or more first receptacles disposed on the lower surface of the sole layer; or the second face of the rotatable traction portion includes one or more second hooks for latching engagement with a corresponding one or more second receptacles disposed on the lower surface of the sole layer.

11. The anti-slip footwear of claim 3, wherein the rotatable traction portion is disposed proximate to a toe portion of the sole layer when the rotatable traction portion is in the first position.

12. The anti-slip footwear of claim 3, wherein:

the rotatable traction element is rotatable about an axis of rotation that is perpendicular to a longitudinal axis of the sole layer; and the longitudinal axis of the sole layer extends from the toe portion of the sole layer to a heel portion of the sole layer.

13. The anti-slip footwear of claim 3, wherein:

the rotatable traction portion further includes at least one actuation element for rotating the rotatable traction portion between the first position and the second position; and the at least one actuation element extends beyond an outer edge of the sole layer when the rotatable traction portion is in the first position and when the rotatable traction portion is in the second position.

14. The anti-slip footwear of claim 13, wherein the at least one actuation element comprises a tab integrally formed with the rotatable traction portion and extending from the rotatable traction portion in a direction orthogonal to a longitudinal axis of the sole layer.

15. The anti-slip footwear of claim 1, wherein the one or more friction reducing elements are integrally formed with the sole layer.

16. The anti-slip footwear of claim 1, wherein the one or more friction reducing elements included on the lower surface of the sole layer comprise a first set of rib elements extending from the lower surface of the sole layer.

17. The anti-slip footwear of claim 16, wherein the second face of the rotatable traction portion includes a second set of rib elements that are substantially coplanar with the first set of rib elements when the rotatable traction portion is in the first position.

18. The anti-slip footwear of claim 1, wherein:

the one or more friction pads of the rotatable traction element are configured to increase a friction force between the anti-slip footwear and an omnidirectional treadmill; and at least a portion of the sole layer is configured to decrease a friction force between the anti-slip footwear and the omnidirectional treadmill.

19. The anti-slip footwear of claim 1, further comprising a second rotatable traction portion rotatably coupled to the lower surface of the sole layer, wherein the rotatable traction portion is disposed proximate to a toe portion of the sole layer and the second rotatable traction portion is disposed proximate to a heel portion of the sole layer.

20. The anti-slip footwear of claim 1, wherein:

the sole layer is included in an overshoe configured to receive a user footwear; and the upper surface of the sole layer includes one or more footwear attachment elements for securing an outer surface of the user footwear to the sole layer.

* * * * *